United States Patent [19]

Instance

[11] Patent Number: 4,637,633

[45] Date of Patent: Jan. 20, 1987

[54] LABEL IN THE FORM OF A SHEET AND ENVELOPE

[76] Inventor: David J. Instance, Past Heap Farm, Pembury, Tunbridge Wells, Kent, England

[21] Appl. No.: 727,687

[22] Filed: Apr. 26, 1985

Related U.S. Application Data

[63] Continuation-in-part of Ser. No. 471,846, Mar. 3, 1983, abandoned.

[30] Foreign Application Priority Data

Mar. 4, 1982 [GB] United Kingdom ..... 8206331

[51] Int. Cl.[4] ..... B42D 15/00; B41L 1/20; B26F 3/02

[52] U.S. Cl. ..... 283/81; 283/1 B; 282/11.5 R; 229/92.7; 281/5

[58] Field of Search ..... 283/1 B, 81; 282/11.5 R, 25, 27 A, 27 R; 229/92, 92.7, 74; 281/2, 3

[56] References Cited

U.S. PATENT DOCUMENTS

| | | | |
|---|---|---|---|
| 763,035 | 6/1904 | Archer . | |
| 797,738 | 8/1905 | Leopold . | |
| 1,610,935 | 12/1926 | Delvay . | |
| 1,924,909 | 8/1933 | Brown | 283/1 B |
| 1,952,972 | 3/1934 | Councilor | 283/1 B |
| 2,072,040 | 2/1937 | Lee et al. | 283/1 B |
| 2,405,327 | 8/1946 | Rend | 225/92.7 |
| 2,809,778 | 10/1957 | Harrison . | |
| 3,711,012 | 1/1973 | Cytron et al. . | |
| 4,153,163 | 5/1979 | Alderman et al. . | |

FOREIGN PATENT DOCUMENTS 1475304 6/1977 United Kingdom .

*Primary Examiner*—Paul A. Bell
*Assistant Examiner*—Paul M. Heyrana, Sr.
*Attorney, Agent, or Firm*—Burns, Doane, Swecker & Mathis

[57] ABSTRACT

A label in the form of a sheet (e.g. a sheet of printed instructions) and an envelope therefor, both formed from a single folded sheet e.g. of paper, wherein the single sheet is divided into at least two parallel rows of three rectilinear panels each, the panels of the first row being separated from the corresponding panels of the next row by a line of perforations and each of the two outer panels of the first row of panels having a portion cut away inwardly from the respective outer edge of the sheet adjacent the line of perforations so that the line of perforations stops short of the outer edges of the sheet, the single sheet being so folded that the panels of the first row form the envelope, and the sheet is composed of the panels of the next row and of any further rows which are folded to lie adjacent one face of the corresponding panels of the first row, whereby the sheet is enclosed in the envelope but can be removed and detached therefrom by tearing along the line of perforations.

9 Claims, 8 Drawing Figures

LABEL IN THE FORM OF A SHEET AND ENVELOPE

This application is a C1P of application No. 471,846, filed Mar. 31, 1983 now abandoned.

BACKGROUND AND OBJECT OF THE INVENTION

This invention relates to a label in the form of a sheet (e.g. a sheet of printed instructions) and an envelope.

It is frequently desirable to be able to attach to a product a label including a sheet of printed instructions, and, to avoid soiling of the sheet during handling of the product or loss of the sheet during such handling, it is desirable that the sheet should be enclosed in an envelope and held from falling out. If the means for holding the sheet can be made such as to require a non-repeatable action to remove the sheet from the envelope, they will afford an indication of unauthorised tampering.

In my British Pat. No. 1475304 there is described and claimed a sheet (e.g. of printed instructions) and an envelope therefor both formed from a single folded sheet, e.g. of paper, the single sheet being divided into at least two parallel rows of three rectilinear panels each, the two outer panels of a first row being separated from the corresponding two outer panels of the next row by cuts and the middle panels of the said first and next rows being joined to one another through a line of perforations aligned with the cuts, the single sheet being so folded that the panels of the first row form the envelope and the sheet, e.g. of instructions, is composed of the panels of the next row and of any further rows which are folded to lie adjacent one face of the middle panel of the first row, whereby the sheet e.g., of instructions, is enclosed in the envelope but can be removed and detached therefrom by tearing along the line of perforations.

I have found that the sheet and envelope described in my British Pat. No. 1475304 can suffer from the disadvantage, particularly if the resultant envelope is over a certain size, that when the sheet of instructions is first pulled out of the envelope and the said line of perforations has to be torn apart, quite often before the line of perforations will tear, the sheet of instructions pulls upwardly that part of the sheet which forms the lower part of the envelope. This causes the envelope to become buckled and misaligned so that re-introduction of the sheet of instructions into the envelope can be difficult, if not impossible.

SUMMARY OF THE INVENTION

I have now devised a modified label in the form of a sheet and envelope which overcomes this disadvantage. Accordingly the present invention provides a label in the form of an integral sheet/envelope for attachment to a product, said label comprising a sheet portion such as a sheet of printed instructions, and an envelope portion for removably carrying said sheet portion, said sheet portion and envelope portion being both formed from a common single folded sheet, said sheet comprising opposing side edges interconnected by opposing end edges, said sheet being divided into at least first and second parallel rows of three rectilinear panels each, the panels of said first row forming one of said end edges and being separated from the corresponding panels of said second row by a line of perforations which extends transversely relative to said side edges of said sheet, said first row of three panels including two outer panels which each have a portion thereof cut away inwardly from respective side edges adjacent said line of perforations so that said line of perforations stops short of said side edges, said second row of panels together with a part of the center panel of the first row being folded so as to lie adjacent corresponding panels of said first row, said two outer panels of said first and second rows being folded behind the remaining center panels such that said first row of panels defines said envelope portion which contains said sheet portion defined by said second row of panels, the cut away portions being dimensioned so that when the envelope portion is folded the cut away portions expose a rearwardly facing region of said part of the center panels of the first row, the rear of said envelope portion being formed from the outer panels of the first row and said region, a front face of said center panel of said first row forming an exposed front of said envelope portion, said envelope portion remaining open along said one end edge which remains uncovered so that when the rear of the envelope portion is attached to a surface, said sheet portion is removable from said envelope portion through said one end edge, while said envelope portion remains folded, by tearing said sheet portion along said line of perforations.

With the arrangement of the present invention, when the sheet has been duly folded to form the completed label in the form of a combined instruction sheet and envelope, the cut-out portions provided on each side of the sheet are brought together in such a way that a cut-away area is located immediately behind a central portion of the folded-over rear face of the envelope along the bottom edge thereof. The presence of the cut-away portions means that the said portion of the rear face of the envelope can be adhered directly to a container to which the label in the form of a sheet of instructions and envelope is to be attached. Thus in use the bottom central portion of the rear face of the envelope is securely attached to the container and results in the sheet of instructions being removable from the envelope by tearing along the line of perforations without this part of the envelope being pulled upwards to cause the undesired buckling of the envelope.

Preferably, said line of perforations is disposed parallel to a fold line about which said second row and said part of the central panel of the first row are folded, said line of perforations being spaced from said fold line by a short distance in a direction away. from said one end edge, said fold line being spaced midway between said first and second row of panels.

Preferably, the folding of said second row of panels and said part of the central panel of the first row occurs about a fold line oriented parallel to said line of perforations and spaced therefrom a short distance toward said one end edge, each said cut away portion having first and second sections situated on opposite sides of said fold line so that upon folding of said second row of panels about said fold line said first and second sections of each said cut away portion overlap.

In a preferred arrangement said at least first and second rows further comprises third and fourth rows of three panels each, said fourth row defining the other of said end edges and being joined to said third row by an upper fold line, said third row being joined to said second row by a middle fold line, the distance between said middle fold line and said upper fold line being equal to the distance between said middle fold line and said upper fold line and equal to the distance between said upper fold line and said other end edge, said fourth, third, and second rows of panels being folded to lie adjacent the corresponding panels of said first row, said panels of said first row surrounding said panels of said fourth, third, and second rows.

In a preferred arrangement, the label further comprises a support web having a front surface to which said rear of the envelope portion is adhered and a rear surface which is self-adhesive.

BRIEF DESCRIPTION OF THE DRAWINGS

Various embodiments of the invention will now be described by way of example only with reference to the accompanying drawings, in which.

DETAILED DESCRIPTION OF PREFERRED EMBODIMENTS OF THE INVENTION

Figure 1:
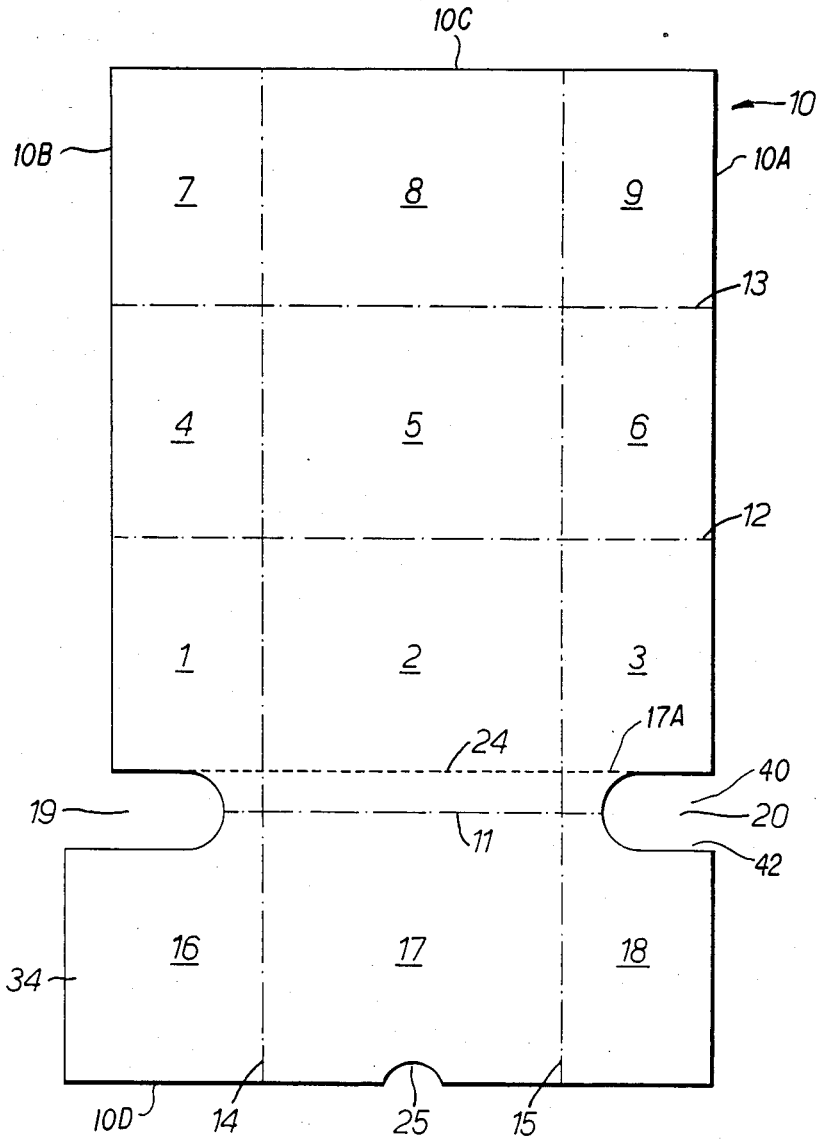
FIG. 1 is a plan view of one embodiment of a rectangular sheet to form a label in accordance with the invention, the sheet being prepared for folding to form a combined instruction sheet and envelope.

As shown in FIG. 1, the sheet 10 has opposing side edges lOA, lOB connected by opposing end edges lOC, lOD and is divided into four horizontal rows of three panels each. Horizontal lines 11, 12 and 13 and vertical lines 14 and 15, along which the sheet is subsequently to be folded, are shown in FIG. 1, but such lines need not exist on the sheet prior to the folding operations illustrated in FIGS. 2 to 5 and described below. The vertical fold lines 14 and 15 are located so that the central panel 2, 5, 8, 17 in each row is approximately twice as wide as the outer panels in each row.. A further horizontal line parallel to and spaced a short distance above the lower horizontal line 11, consists of a line of perforations 24, and divides the instruction sheet portion {above this line) formed of nine panels 1 to 9 from the envelope portion below, formed of three panels 16, 17 18. Thus, a part 17A of the central panel 17 is disposed between the lines 24, 11. The sheet 10 from which the folded sheet of instructions and envelope are formed is cut so that panel 16 is wider than corresponding panels 1, 4 and 7. As a result, after the instruction sheet has been folded as shown in FIGS. 2 to 4, a flap portion 34 is left extending beyond the outer edge of the folded instruction sheet and this can readily be glued to the back of folded panel 18 to form the envelope for enclosing the instruction sheet as shown in FIG. 5.

Conveniently, as shown, the vertical distance from the lower edge of the sheet 10 to the lower horizontal fold line 11 is equal to the distance between the horizontal fold lines 11 and 12, while the distance between the line of perforations 24 and the horizontal fold line 12 is equal to the distance between the horizontal fold line 12 and the horizontal fold line 13, which is in turn equal to the distance between the horizontal fold line 13 and the upper edge of the sheet 10.

The length of the panels 16, 17, 18 of the bottom row, forming the envelope portion of the sheet, is thus slightly greater than that of the panels 1, 2, 3 of the second row, the panels 4, 5, 6 of the third row, and the panels 7, 8, 9 of the top row. The panels 1 to 9 form the instruction sheet portion and are all available for carrying printed instructional matter, if desired. A cut-out 25 is provided in the middle of the lower end edge lOD of the sheet. Additional cut-out portions 19, 20 are provided one on each side edge of the sheet lying immediately below the line of perforations 24 and extending approximately half-way into the respective outer panels 16 and 18. Each cut-out portion includes first and second sections 40, 42 situated on opposite sides of the fold line 11. These sections become overlapped when the panels 1 to 9 are folded about the fold line 11 (see FIG. 4).

Figure 2:
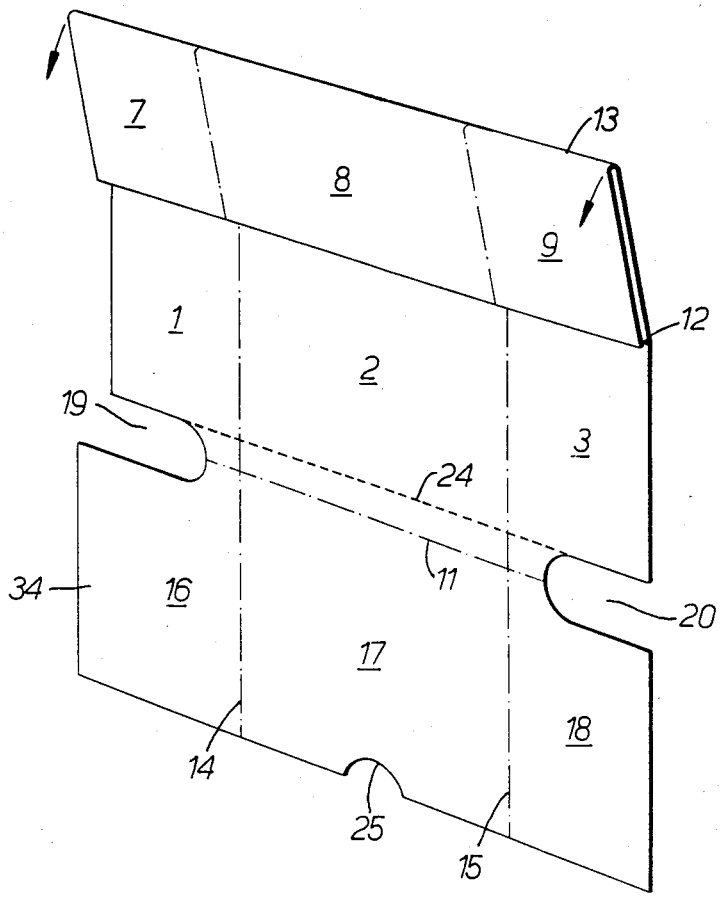
FIG. 2 is a perspective view illustrating the first folding operation completed and the commencement of the second folding operation on the instruction sheet of FIG. 1.
Figure 3:
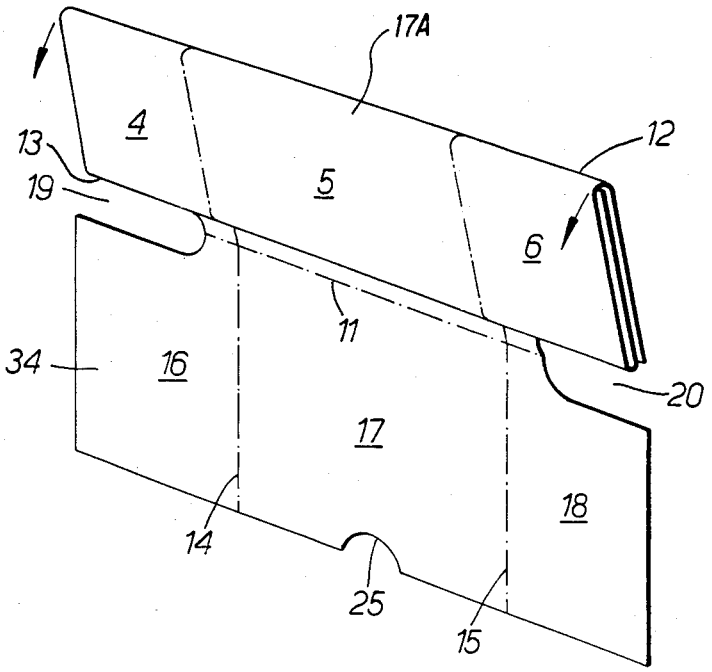
FIG. 3 is a perspective view showing the second folding operation completed and the commencement of the third folding operation.
Figure 4:
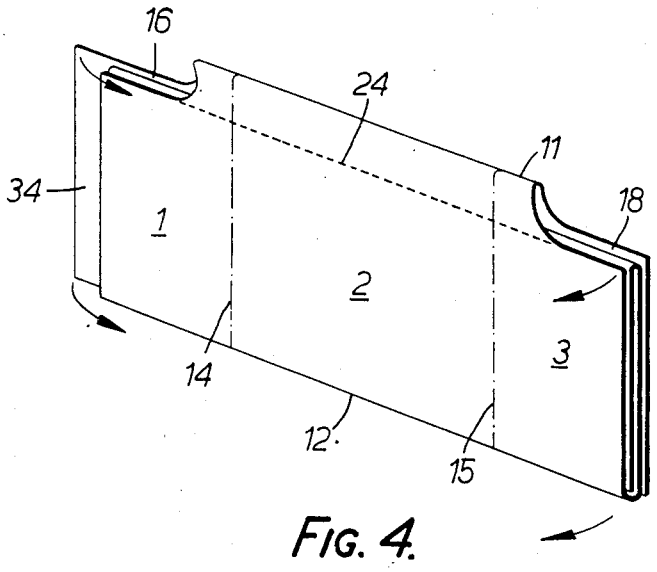
FIG. 4 is a perspective view showing the third folding operation completed, with the instruction sheet fully folded, and the beginning of the fourth folding operation to commence enclosure of the instruction sheet in the envelope.
Figure 5:
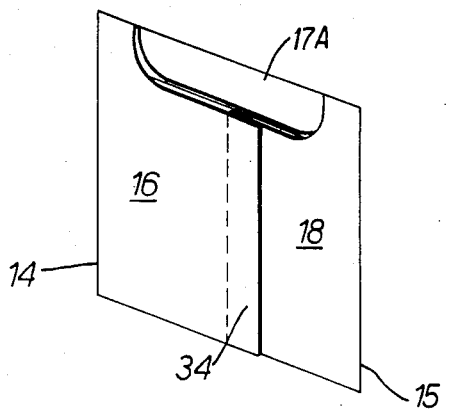
FIG. 5 shows the fourth folding operation completed and a perspective rear view of the completed label in the form of a combined instruction sheet and envelope.

The folding operations by which the instruction sheet portion is enclosed in the envelope portion are illustrated in FIGS. 2 to 5. First, as shown in FIG. 2, the uppermost portion of the sheet, consisting of the two upper rows of panels 4 to 9, is folded forward first about the uppermost horizontal fold line 13, and then about horizontal fold line 12, so as to lie against the first row of panels 1, 2, 3 of the instruction sheet. Secondly, as shown in FIG. 3, the folded rows of panels are folded forward about the horizontal fold line 11 until all nine panels 1 to 9 of the instruction sheet portion lie over the three panels 16, 17, 18 of the envelope portion as shown in FIG. 4. Thirdly, as shown in FIG. 4, the outer panels on each side of the folded sheet are folded about vertical fold lines 14 and 15 to lie over central panel 2 and the portion 17A, a region of the latter thus remaining exposed. When the last fold is completed, the extended flap portion 34 of panel 16 is glued, e.g. by spot gluing, to the back of folded panel 18 so that panels 16, 17 and 18 form the envelope containing the folded instruction sheet within it as shown in FIG. 5.

The instruction sheet consisting of panels 1 to 9 can be removed from the envelope formed by panels 16, 17, 18 by gripping it through the cut-out 25 and pulling it so as to tear it off along the line 24 of perforations. The sheet can then be removed from the envelope in the end edge lOD which remains open.

Figure 8:
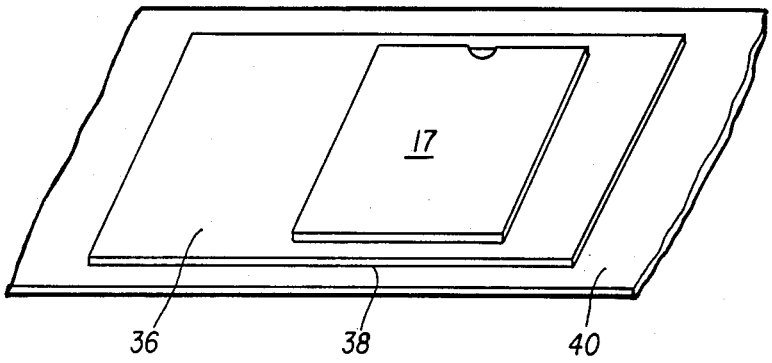
FIG. 8 is a persepctive view of the folded label of FIG. 5 when adhered to a self-adhesive support web in a preferred arrangement of the invention.

FIG. 8 shows the label of FIG. 5 when adhered to a support web. The rear surface of the label, consisting of the rearwardly-facing exposed surfaces of panels 16, 17A and 18 is adhered e.g. by a layer of adhesive to a support web 36 for carrying the label. The support web 36 is a sheet of paper which is coated on its reverse side by a layer 38 of a pressure sensitive adhesive so that the support web 36 is self-adhesive. The self-adhesive surface of the support web 36 is adhered to a backing 40 of release material which is preferably a silicone-coated paper. The support web 36 carrying the label may be separated from the backing 40 and then adhered by the self-adhesive surface to a container to be labelled.

The front surface of the panel 17 and the exposed front surface of the support web 36 may be printed with information relating to the product in the container to be labelled.

A great advantage of the arrangement shown in FIG. 8 is that a number of self-adhesive labels can be carried in succession on a length of the backing 40 of release material which may conveniently be wound into a reel. The self-adhesive labels can readily be removed successively from the backing 40 of realese material for application to containers to be labelled.

In both arrangements when the folded sheet and envelope is adhered either directly or via the support web 36 to a container, each of the rearwardly facing panels 16, 17A and 18 is adhered. Since panel 17A is adhered directly either to the container or to the support web 36, it is restrained from being pulled upwardly when the sheet of instructions is separated from and pulled upwardly out of the envelope by tearing along the line of perforations 24. Thus panel 17A is not torn or buckled when the sheet of instructions is removed from the envelope. This overcomes the problems encountered with my earlier sheet and envelope arrangement.

Figure 6:
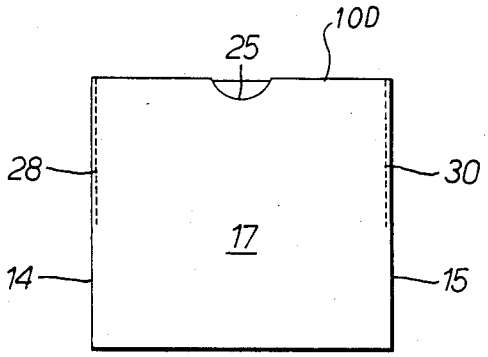
FIG. 6 shows a front view of an alternative completed combined instruction sheet and envelope.

In an alternative embodiment, as shown in FIG. 6, the central panel 17 forming the front face of the envelope is provided with two vertical lines of perforations 28, 30 running parallel to and just inwardly from respective vertical fold lines 14, 15 and extending downwardly from the top edge of panel 17 for a suitable distance. In such an arrangement the sheet of instructions can be removed by pulling outwardly the top of the front face of the envelope to tear the two lines of perforations 28, 30 thereby to give easy access to the folded sheet of instructions within the envelope, and then by pulling the sheet of instructions upwardly to tear the line of perforations 24 securing the sheet of instructions to the envelope.

Figure 7:
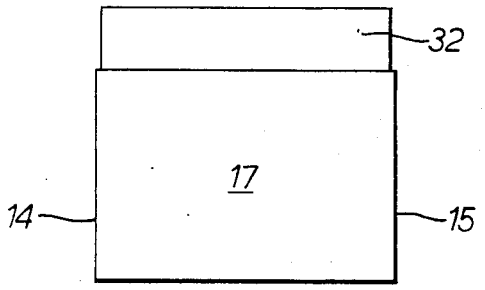
FIG. 7 shows a front view of a further alternative completed combined instruction sheet and envelope.

In a further alternative arrangement shown in FIG. 7, the sheet of instructions is folded in such a way that the height of the rows of panels is such that in the completed envelope and instruction sheet the top 32 of the instruction sheet protrudes from the top of the envelope. The instruction sheet can be removed by holding the top 32 of the instruction sheet and pulling upwardly to tear the line of perforations 24 securing the sheet of instructions to the bottom portion of the envelope.

Although the sheet of instructions described above has been depicted as having three horizontal rows of panels, it will be evident that if a greater amount of information must be printed a larger sheet can be used by. using a longer sheet which is folded more times and thus has more than three rows of panels. Similarly, if a shorter sheet of instructions is used, less than three horizontal rows of panels can be used.

Moreover, although the folding of the sheet about the horizontal fold lines has been shown to be in the manner of forming a scroll, folding about the horizontal fold lines can be performed in concertina-like manner.

I claim:

1. A label in the form of an integral sheet/envelope for attachment to a product, said label comprising a sheet portion such as a sheet of printed instructions, and an envelope portion for removably carrying said sheet portion, said sheet portion and envelope portion being both formed from a common single folded sheet, said sheet comprising opposing side edges interconnected by opposing end edges, said sheet being divided into said least first and second parallel rows of three rectilinear panels each, the panels of said first row forming one of said end edges and being separated from the corresponding panels of said second row by a line of perforations, which extends transversely relative to said side edges of said sheet, said first row of three panels including two outer panels which each have a portion thereof cut away inwardly from respective side edges adjacent said line of perforations so that said line of perforations stops short of said side edges, said second row of panels together with a part of the center panels of the first row being folded so as to lie adjacent corresponding panels of said first row, said two outer panels of said first and second rows being folded behind the remaining center panels such that said first row of panels defines said envelope portion which contains said sheet portion defined by said second row of panels, both cut away portions being dimensioned so that when the envelope portion is folded both cut away portions expose a rearwardly facing region of said part of the center panel of the first row, the rear of said envelope portion being formed from the outer panels of the first row and said region, a front face of said center panel of said first row forming an exposed front of said envelope portion, said envelope portion remaining open along said one end edge which remains uncovered so that when the rear of the envelope portion, including said exposed region thereof, is attached to a surface, said sheet portion is removable from said envelope portion through said one end edge, while said envelope portion remains folded, by tearing said sheet portion along said line of perforations as said exposed region remains attached to the surface.

2. A label according to claim 1, wherein said line of perforations is disposed parallel to a fold line about which said second row and said part of the central panel of the first row are folded, said line of perforations being spaced from said fold line by a short distance in a direction away from said one end edge, said fold line being spaced midway between said first and second row of panels.

3. A label according to claim 1, wherein the folding of said second row of panels and said part of the central panel of the first row occurs about a fold line oriented parallel to said line of perforations and spaced therefrom a short distance toward said one end edge, each said cut away portion having first and second sections situated on opposite sides of said fold line so that upon folding of said second row of panels about said fold line said first and second sections of each said cut away portion overlap.

4. A label according to claim 3, wherein said fold line is spaced midway between said first and second rows of panels.

5. A label according to claim 4, wherein said at least first and second rows further comprises third and fourth rows of three panels each, said fourth row defining the other of said end edges and being joined to said third row by an upper fold line, said third row being joined to said second row by a middle fold line, the distance between said middle fold line and said upper fold line being equal to the distance between said middle fold line and said upper fold line and equal to the distance between said upper fold line and said other end edge, said fourth, third, and second rows of panels being folded to lie adjacent the corresponding panels of said first row, said panels of said first row surrounding said panels of said fourth, third, and second rows.

6. A label according to claim 3, wherein each outer panel is substantially half as wide as the central panel in the respective row.

7. A label according to claim 5, wherein each outer panel is substantially half as wide as the central panel in the respective row.

8. A label according to claim 3, wherein one of the outer panels of said first row of panels includes a lateral flap portion which overlaps the outer outer panel of said first row.

9. A label according to claim 1 further comprising a support web having a front surface to which said rear of the envelope portion is adhered and a rear surface which is self-adhesive.

* * * * *